US005820305A

United States Patent [19]

Taylor et al.

[11] Patent Number: 5,820,305

[45] Date of Patent: Oct. 13, 1998

[54] T-BLOCK WALL SYSTEM

[76] Inventors: Thomas P. Taylor, 2500 Cranberry La., Euless, Tex. 76039; William K. Hilfiker, 2202 Lakeridge Dr., Grapevine, Tex. 76051

[21] Appl. No.: 874,361

[22] Filed: Jun. 13, 1997

Related U.S. Application Data

[63] Continuation of Ser. No. 585,568, Jan. 16, 1996, Pat. No. 5,702,208, which is a continuation-in-part of Ser. No. 252, 738, Jun. 2, 1994, Pat. No. 5,484,235.

[51] Int. Cl.[6] ..... E02D 29/02

[52] U.S. Cl. ..... 405/286; 52/574; 52/605; 52/611; 405/262; 405/284

[58] Field of Search ..... 405/284, 286, 405/262, 258, 272, 273; 52/611, 574

[56] References Cited

U.S. PATENT DOCUMENTS

| | | | |
|---|---|---|---|
| Re. 13,299 | 10/1911 | Denison | 52/611 |
| 991,041 | 5/1911 | Toennes | 405/20 |
| 1,144,143 | 6/1915 | McGillivray | 405/20 |
| 1,813,912 | 7/1931 | Clark | 52/606 |
| 1,959,816 | 5/1934 | Crum . | |
| 1,992,785 | 2/1935 | Steuer . | |
| 2,137,153 | 11/1938 | Brozek | 52/574 |
| 2,208,589 | 7/1940 | Leemhuis | 52/274 X |
| 2,275,933 | 3/1942 | Werner | 52/608 |
| 2,327,640 | 8/1943 | Hendry | 404/40 X |
| 2,552,712 | 5/1951 | Ellis . | |
| 2,703,963 | 3/1955 | Gutierrez | 405/262 |
| 2,881,614 | 4/1959 | Preininger . | |
| 3,597,928 | 8/1971 | Pilaar | 405/20 |
| 3,998,022 | 12/1976 | Muse | 52/574 |
| 4,117,686 | 10/1978 | Hilfiker | 405/284 |
| 4,123,881 | 11/1978 | Muse | 52/100 |
| 4,134,241 | 1/1979 | Walton | 52/574 X |
| 4,286,895 | 9/1981 | Poli et al. | 405/17 |
| 4,324,508 | 4/1982 | Hilfiker et al. | 405/284 |
| 4,329,089 | 5/1982 | Hilfiker et al. | 405/262 |
| 4,411,255 | 10/1983 | Lee | 126/429 |
| 4,651,975 | 3/1987 | Howell | 404/35 X |
| 4,653,962 | 3/1987 | McKittrick et al. | 405/286 |
| 4,661,023 | 4/1987 | Hilfiker | 405/262 |
| 4,664,552 | 5/1987 | Schaaf | 405/19 X |
| 4,834,584 | 5/1989 | Hilfiker | 405/262 |
| 4,920,712 | 5/1990 | Dean | 52/169.4 |
| 4,993,879 | 2/1991 | Hilfiker | 405/262 |
| 5,076,735 | 12/1991 | Hilfiker | 405/258 X |
| 5,257,880 | 11/1993 | Janopaul, Jr. | 405/284 |
| 5,474,405 | 12/1995 | Anderson et al. | 405/286 |

FOREIGN PATENT DOCUMENTS

| | | | |
|---|---|---|---|
| 530097 | 9/1921 | France | 52/574 |
| 1006087 | 1/1952 | France | 52/574 |

OTHER PUBLICATIONS

Section 02276/Key/BuyLine 2802, "Keystone Retaining Wall systems," Sweet's Engineering and Retrofit: Mechanical, Electrical, Civil/Structural 1993 Catalog File, published by McGraw–Hill (1993).

(List continued on next page.)

*Primary Examiner*—Dennis L. Taylor
*Attorney, Agent, or Firm*—Limbach & Limbach L.L.P.

[57] ABSTRACT

A precast concrete block having a first single thickness generally planar face section and a second single thickness generally planar backing section integrally formed with and extending from the first section to form a structure of a T-shaped configuration. A groove extends across and opens through an upper edge of the second planar section for the receipt of a rebar. The blocks are assembled into stacked side-by-side relationship and a panel is formed by casting concrete against the side of the generally planar face sections from which the backing sections extend. Rebar extends across and through the grooves of at least certain of the blocks to maintain the blocks in aligned side-by-side relationship and reinforce the concrete cast against the blocks. The panels are used in the construction of retaining walls for earthen formations and may be precast or formed in place at the situs of the formations. When used in the construction of retaining walls, vertical rebars extend into the cast concrete from a foundation supporting the panels and connectors may be provided to secure the panels to anchor elements within the earthen formation.

27 Claims, 11 Drawing Sheets

OTHER PUBLICATIONS

Section 02276/Roc/BuyLine 6342, "Rockwood Retaining Wall Systems," Sweet's Engineering and Retrofit: Mechanical, Electrical, Civil/Structural 1993 Catalog File, published by McGraw–Hill (1993).

Section 02276/GRB/BuyLine 6579, "Gravity Retaining Walls Incorporated," Sweet's Engineering and Retrofit: Mechanical, electrical, Civil/Structural 1993 Catalog File, published by McGraw–Hill (1993).

Section 02276/AND/BuyLine 7682, "Diamond, the Pinless System," Sweet's Engineering and Retrofit: Mechanical, Electrical, Civil/Structural 1993 Catalog File, Published by McGraw–Hill (1993).

*Erosion Control*, Sep./Oct. 1995, p. 28, advertisement for American Excelsior Company.

Presto Products Company advertisement for Geoweb.

*Erosion Control*, Sep./Oct. 1995, p. 30, EnviroGrid advertisement for Cellular Confinement Systems.

*Erosion Control*, Sep./Oct. 1995, p. 38, Manta Ray Earth Anchor systems advertisement.

*Erosion Control*, Sep./Oct. 1995, p. 63, International Erosion Control System, LLC. advertisement for Cable Concrete.

*Erosion Control*, Nov./Dec. 1995, p. 26, Pavestone Co. advertisement.

T-BLOCK WALL SYSTEM

RELATED APPLICATION

This application is a continuation of application Ser. No. 08/585,568 filed by the inventors herein on Jan. 16, 1996, now U.S. Pat. 5,702,208, which application in turn is a continuation in part of application Ser. No. 08/252,738, filed by the inventors herein on Jun. 2, 1994, now U.S. Pat. No. 5,484,235.

FIELD OF THE INVENTION

The present invention relates to an improved T-shaped concrete block which is adapted to be assembled into a reinforced concrete wall. In its more specific aspects, the invention is concerned with a wall system fabricated of such blocks which may be precast and moved to the situs where it is to be used, or cast in place at the situs. It is also concerned with such a wall which may have the T-blocks on one or both sides and may be of varying thicknesses depending upon the spacing of the blocks. When used back-to-back on both sides of the wall, separate forming elements are not required to contain cement cast in place against the blocks.

BACKGROUND OF THE INVENTION

The prior art teaches the provision of T or Z-shaped blocks which interlock and are held against separation by clips extending across grooves in the blocks; see for example U.S. Pat. No. 3,998,022 and 4,123,881. As contrasted to the blocks of the present invention, the blocks of these patents are doubled walled and form voids between the walls. The prior art also teaches concrete blocks formed with grooves which receive rod or clip-like members to hold the assembled blocks in aligned side-by-side relationship. U.S. Pat. Nos. 1,959,816 and 1,992,755 are typical of such constructions. It is also known in the prior art to secure stacked panels for earthen formations in aligned condition through the provision of plates, rods and/or pins extending across the panels and to secure such panels to soil reinforcing gridworks embedded within the earthen formation being retained. U.S. Pat. Nos. 4,324,508 and 4,661,023 exemplify walls of the latter type.

SUMMARY OF THE INVENTION

The principal element of the present invention comprises a T-shaped concrete block adapted to be assembled into a stacked condition to define the outer surface of a wall or column. The block comprises a first generally planar section of a single thickness having forward and rearward surfaces and a second generally planar section integrally formed with the first planar section. The second planar section is of single thickness and extends from the rearward surface of the first section and terminates in a free distal edge to form a generally T-shaped configuration with the first section. A groove extends across and opens through the upper portion of the second planar section for receipt of a rebar element.

In a second embodiment of the block known as a "twin T-block", a third generally planar section is integrally formed with the first planar section and extends from the rearward surface of the first section in generally spaced relationship to the second planar section. A groove extends across and opens through an upper edge portion of the third planar section for receipt of a rebar element.

The invention is also concerned with assemblies of such blocks as may be used to form precast walls or walls cast in place at the situs where they are to be used. Such assemblies may take the form of free standing walls or columns, or walls secured to an earthen formation to provide the face of a retaining wall for the formation.

A principal object of the present invention is to provide a T-shaped concrete block which may be assembled into various configurations to form rebar reinforced walls and columns.

Another object of the invention is to provide such blocks which do not have integrally formed voids and may be assembled into back-to-back spaced relationship to provide a void therebetween into which cast in place concrete may be formed.

Still another object of the invention is to provide such blocks which may be assembled in single thickness relationship without the creation of voids therebetween and against which concrete may be formed in place.

Yet another object of the invention is to provide such blocks which are formed with grooves for the receipt of rebar reinforcing elements, which elements may serve to reinforce cast in place concrete formed against the blocks and secure the blocks in aligned condition.

A further object of the invention is to provide such a block which may be assembled into a panel and act as a veneer and forming element for a concrete wall cast in place against the panel.

Other objects of the invention are to provide a wall constructed of such blocks which may be freestanding, or may have connecting elements secured thereto for connection to the anchors or soil reinforcing elements of a retaining wall for an earthen formation.

These and other objects will become more apparent from the following detailed description and the accompanying drawings.

DESCRIPTION OF THE PREFERRED EMBODIMENTS

Figure 1:
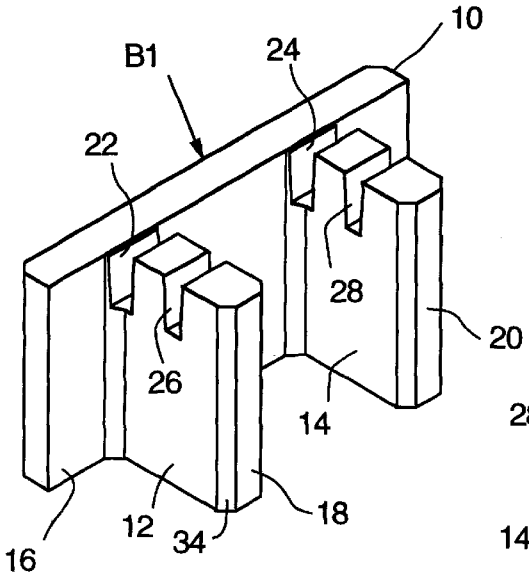
FIG. 1 is a perspective view showing a first embodiment of the inventive block, known as the "Twin-T", viewed from the rearward side.
Figure 2:
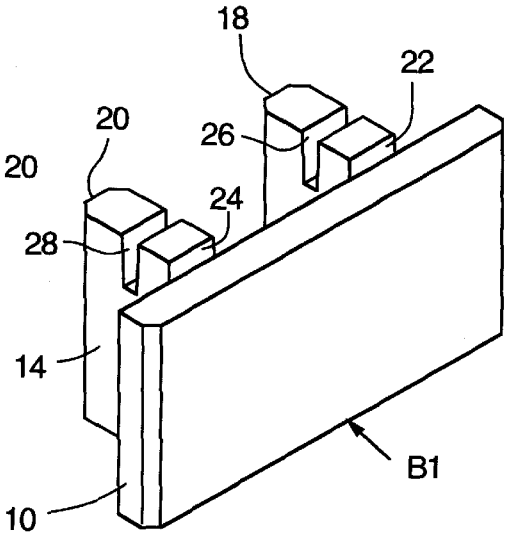
FIG. 2 is a perspective view showing the first embodiment block, viewed from the forward side.

Referring now to FIG. 1, the first embodiment "Twin-T" block is designated in its entirety by the letter B1 and comprises a first or face section 10 having web sections 12 and 14, respectively, integrally formed therewith. The sections 10, 12 and 14 are each of generally planar configuration. Sections 12 and 14 extend from the rearward surface 16 of the face section 10 and terminate in free distal edges 18 and 20, respectively. First aligned grooves 22 and 24 are formed in and open through the upper edge of the web sections 12 and 14 immediately adjacent the rearward surface 16 of the face section 10. Second aligned grooves 26 and 28 are formed in and open through the web sections 12 and 14 in spaced relationship to the rearward surface 16. The first and second aligned grooves are proportioned for the receipt of rebar and have a depth in excess of the cross-section of a rebar element to be received therein.

The blockd can be cast four at a time in a standard concrete block machine. The face can be cast with various textures, such as a fluted fin, by adding a liner to the block mold. The blocks are cast in such a manner that the face can be split apart after casting, using a standard block splitting machine.

Although the dimensions of the block may vary, one exemplary embodiment has the following dimensions:

| | |
|---|---|
| Length of Face Section 10: | 16 Inches |
| Height of Face Section 10 and Web Sections 12 and 14: | 8 Inches |
| Thickness of Face Section 10: | 1-½ Inches |
| Thickness of Web Sections 12 and 14: | 2 Inches |
| Center to Center Spacing of the Web Sections 12 and 14: | 8 Inches |
| Depth of Web Sections 12 and 14: | 5 Inches |
| Depth of Grooves 22, 24, 26 and 28: | 2 Inches |
| Width of Grooves 22, 24, 26 and 28: | ¾ to ½ Inch from Top to Bottom |
| Spacing from front of face Section 10 to Center of Grooves 22, 24: | 2 Inches |
| Spacing from Distal Edges 18, 20 to Center of Grooves 26, 28, respectively: | 2-½ Inches |

Figure 3:
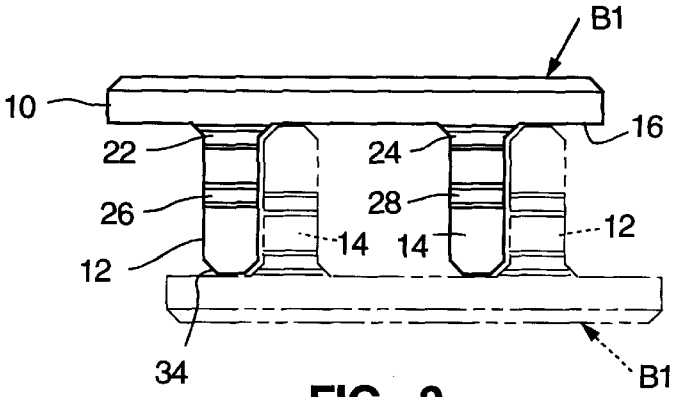
FIG. 3 is a top plan view of the first embodiment block, with a phantom line illustration showing a counterpart block nested back-to-back therewith.
Figure 4:
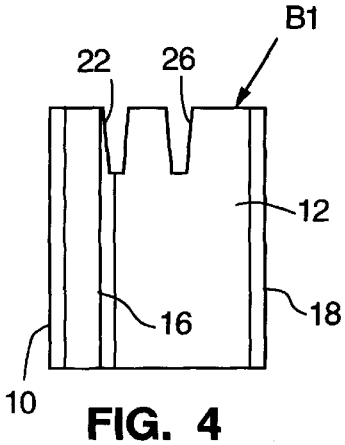
FIG. 4 is an end elevational view of the first embodiment block.
Figure 5:
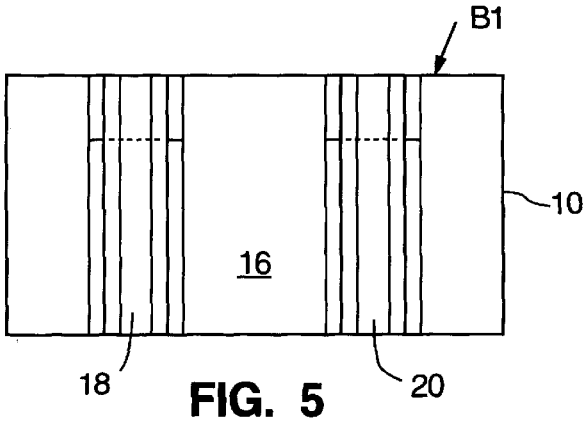
FIG. 5 is a rear elevational view of the first embodiment block.

FIG. 3 illustrates how a pair of the blocks B1 may be assembled back-to-back with the rearward surfaces 16 facing one another. As there shown, the distal edges 16 and 20 of the web sections of one block engage the rearward surface 16 of the face section of the other block. In this condition, the transverse grooves 26, 28 in the respective blocks approximately align.

Figure 6:
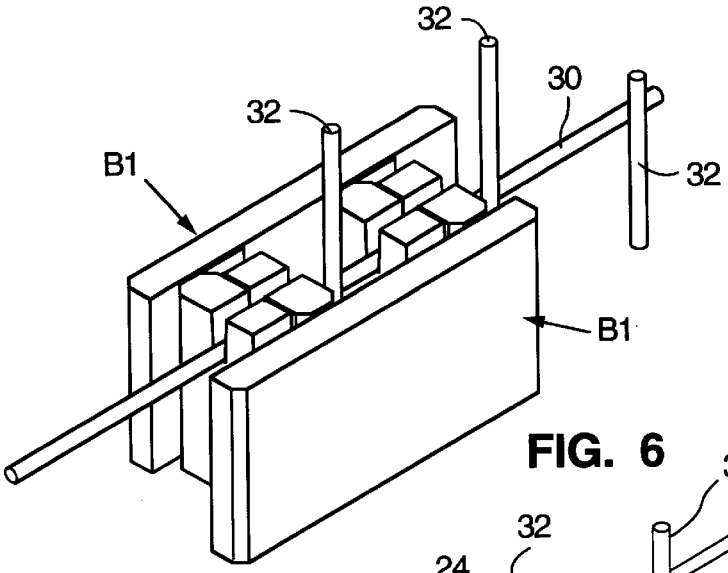
FIG. 6 is a perspective view of a pair of the first embodiment blocks nested in back-to-back relationship, with the grooves formed in the T-sections of the blocks aligned and a rebar extending through the grooves.

FIG. 6 illustrates a pair of blocks B1 assembled in back-to-back relationship as shown generally in FIG. 3, with the addition of a rebar received within the generally aligned grooves 26, 28 to secure the blocks against separation. With the exemplary dimensions given, this rebar would be ½ inch in cross-section. FIG. 6 also shows vertical rebars 32 extending upwardly in the space between the blocks B1. In use, fluid concrete would be filled into the space between the blocks and permitted to set, with the result that the rebars 30 and 32 would be locked in place and function to reinforce the wall formed by the blocks. The wall of FIG. 6 has a width of approximately eight inches.

Figure 7:
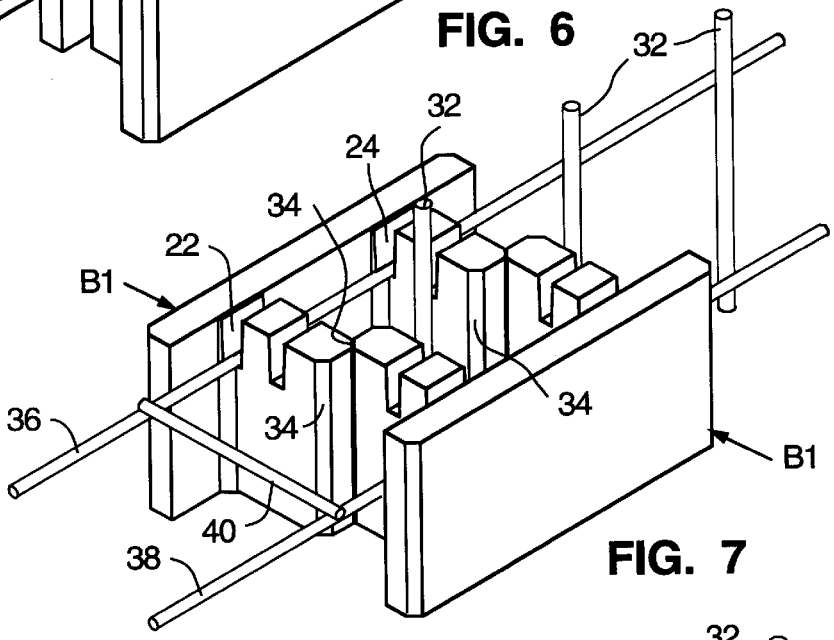
FIG. 7 is a perspective view of a pair of the first embodiment blocks partially nested in back-to-back relationship, with the grooves in the T-sections of the blocks spaced transversely and a welded wire reinforcing grid received with the grooves of the respective blocks in spanning relationship thereto.

FIG. 7 shows a pair of blocks in partially nested condition with chamfers 34 formed on the distal edges 18 and 20 generally in contact. As so assembled, the wall has a width of approximately 12 inches. A ladder-like welded wire reinforcing element comprised of longitudinal wires 36 and 38 and transverse wires 40 is engaged with the blocks. The wire 36 extends through the grooves 22, 24 of one block and the wire 38 extends through the grooves 22, 24 of the other. Thus, the transverse wires secured between the wires 36, 38 function to secure the blocks against separation. As with the FIG. 6 embodiment, the FIG. 7 embodiment is shown with vertical rebars 32 extending between the blocks. Accordingly, concrete cast in place between the blocks is reinforced by both the vertical rebars and the gridwork comprised of the wires 36, 28 and 40.

Figure 8:
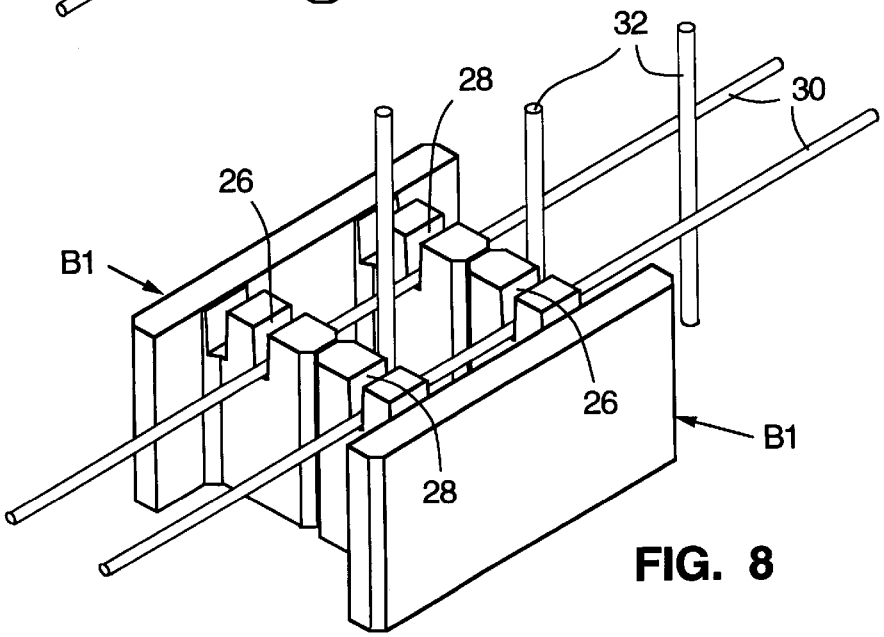
FIG. 8 is a perspective view of a pair of the first embodiment blocks disposed in back-to-back relationship with the T-sections of the blocks aligned in abutting relationship and rebars extending through the grooves in the T-sections.

FIG. 8 illustrates a pair of blocks B1 disposed in opposed relationship with the distal edges 18 and 20 of the web sections in abutting engagement. With the block dimensions given, this results in a wall having a thickness of approximately 13 inches. FIG. 8 shows individual rebars 30 extending through the grooves 26, 28 of the blocks and vertical rebars 32 extending upwardly between the blocks. With this arrangement, concrete set between the blocks forms around the rebars and functions to reinforce the composite well and secure the blocks B1 against separation.

Figure 9:
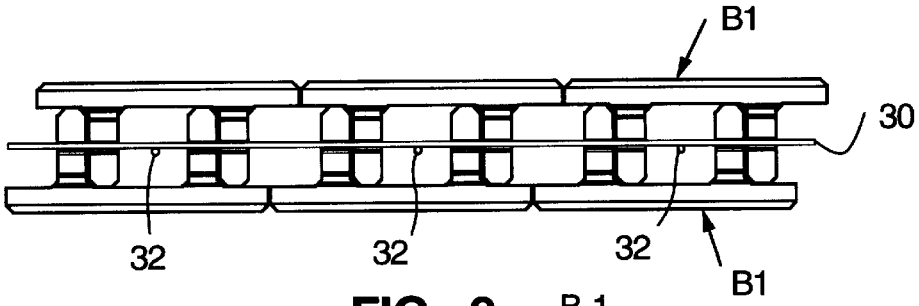
FIG. 9 is top plan view of an 8 inch wide wall constructed of first embodiment blocks nested in back-to-back relationship in the manner illustrated in FIG. 6.

FIG. 9 shows an 8 inch wide wall constructed of an assembly of blocks as seen in FIG. 6, with the rebar 30 extending continuously across the blocks and the vertical rebars 32 extending into alternate voids formed between the blocks. The rebars, together with the concrete filled into the voids between the blocks (not illustrated) reinforces the wall and secure the blocks together.

Figure 10:
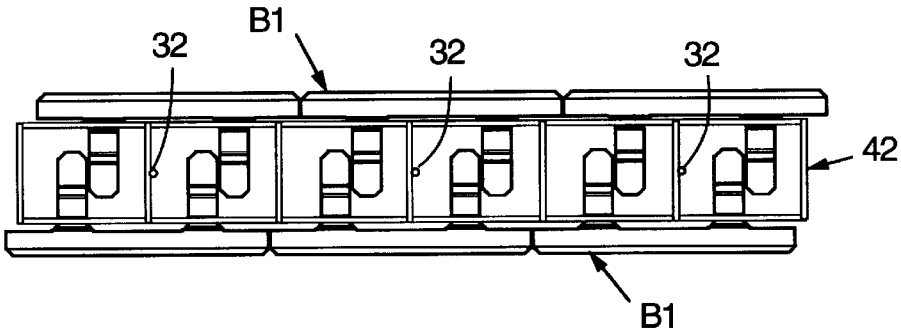
FIG. 10 is a top plan view of a 10 inch wide wall constructed of first embodiment blocks partially nested in back-to-back relationship with a welded wire reinforcing grid received with the grooves of the respective blocks in spanning relationship thereto.

FIG. 10 illustrates a 10 inch wide wall constructed of blocks B1 and a ladder-like wire reinforcing element 42. The FIG. 10 structure is similar to that in FIG. 7, except that the web elements overlap to a greater degree in order to reduce the thickness of the composite wall. Concrete cast in place within the void defined between the block elements is reinforced by the element 42 and functions to rigidify the wall and further secure the blocks together.

Figure 11:
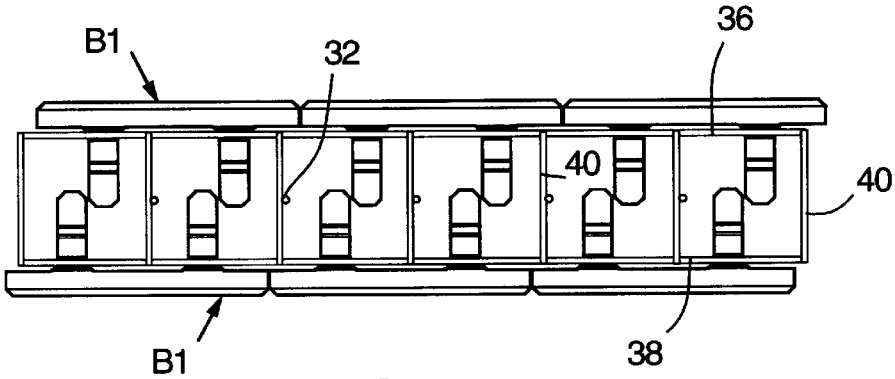
FIG. 11 is top plan view of a 12 inch wide wall constructed of first embodiment blocks nested in back-to-back relationship in the manner illustrated in FIG. 7.

FIG. 11 illustrates a wall constructed according to blocks assembled as shown in FIG. 7. The 12 inch wall thus provided is reinforced by concrete (not illustrated) formed in place within the voids between the blocks.

Figure 12:
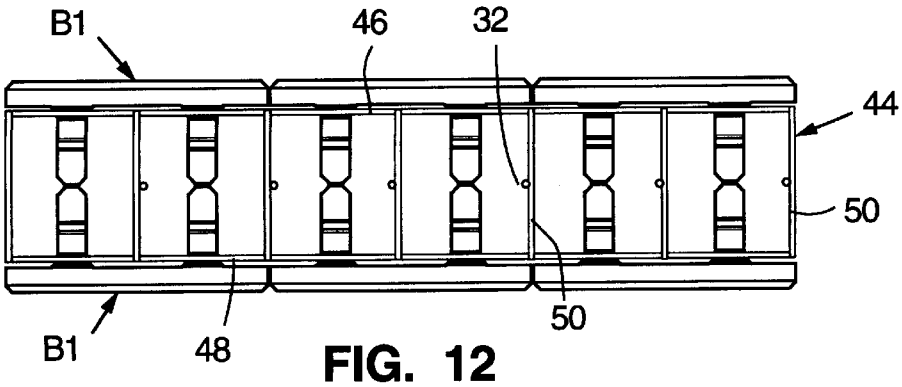
FIG. 12 is a plan view of a 13 inch wide wall constructed of first embodiment blocks disposed in back-to-back relationship with the T-sections of the blocks abutting and a welded wire reinforcing grid received within the grooves of the respective blocks in spanning relationship thereto.

FIG. 12 illustrates a wall with the blocks arranged in the same general manner shown in FIG. 8. In FIG. 12, however, the blocks are tied together by a ladder-like reinforcing element 44 comprised of longitudinal wires 46 and 48 and transverse wires 50. The longitudinal wires 46 extend through the grooves 22, 24 of the blocks on one side of the wall and the wire 48 extends through the grooves 22, 24 of the blocks on the other side of the wall. The transverse wires 50, together with the concrete cast in place between the blocks, reinforces the composite wall structure and secure the blocks against separation.

Figure 13:
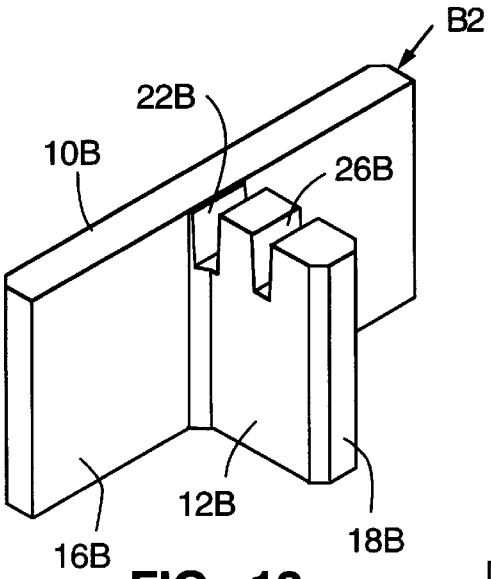
FIG. 13 is a perspective view showing a second embodiment of the inventive block, known as the "Single-T" viewed from the rearward side.
Figure 14:
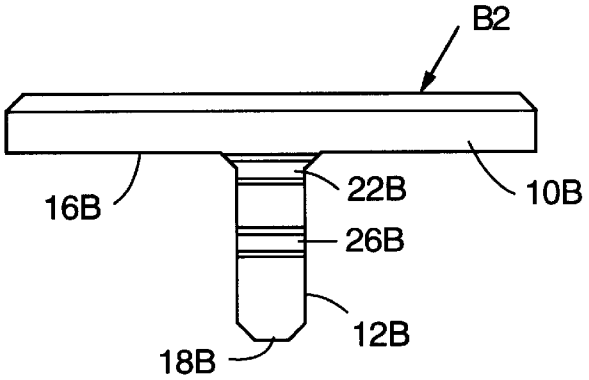
FIG. 14 is a top plan view of the second embodiment block.
Figure 15:
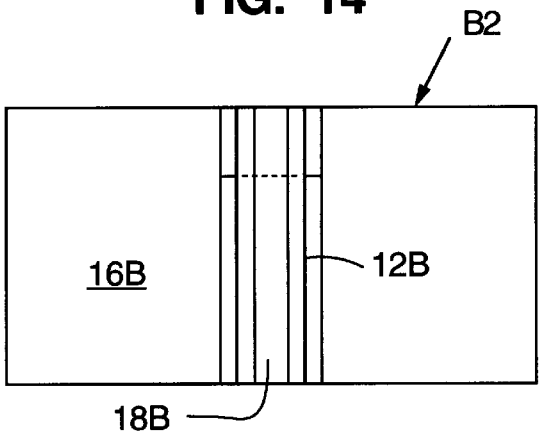
FIG. 15 is a rear elevational view of the second embodiment block.

FIG. 13 to 15 illustrate the second embodiment so called "Single-T" block. This block is designated in its entirety by the character B-2 and corresponds in construction to the block B1, except that it has a single centrally disposed web section 12*b,* rather than the paired web sections of the first embodiment. The components of the second embodiment block are designated by numerals corresponding to those of the first embodiment block, followed by the letter b, as follows: Web section 12*b;* rearward surface 16*b;* free distal edge 18*b;* first groove 22*b*; and second groove 26*b.* The dimensions given for the example of the block B1 could equally apply to the block B2; the primary difference being that the web section 12*b* is at the center of the face section 10. In the example of the block B1 previously described, the web sections are spaced on 8 inch centers and symmetrical with the mid-point of the block.

The block B2 can be used in generally the same manner as the block B1 and is also adapted to be used in combination with the block B1. The choice of which blocks or what combination of blocks is used will depend upon both the dimensions and the strength requirements of the wall being fabricated from the blocks.

Figure 16:
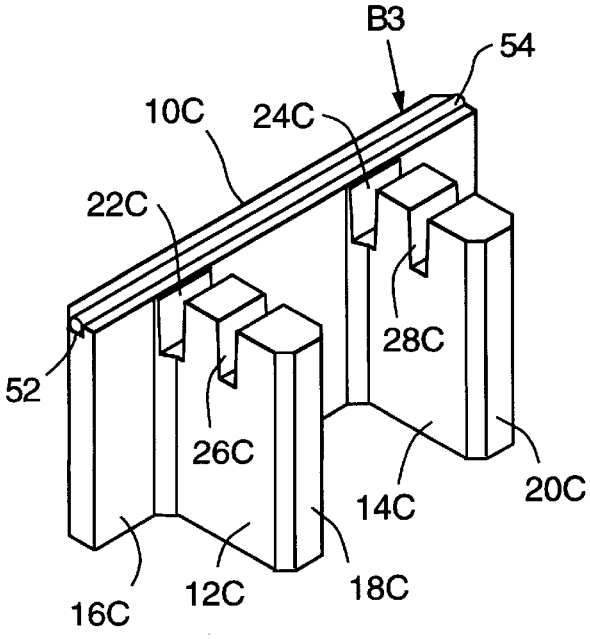
FIG. 16 is a perspective view showing a modification of the first embodiment twin T-block wherein the top of the front face of the block is formed with a sealant groove which receives a resilient foam sealant rod.
Figure 17:
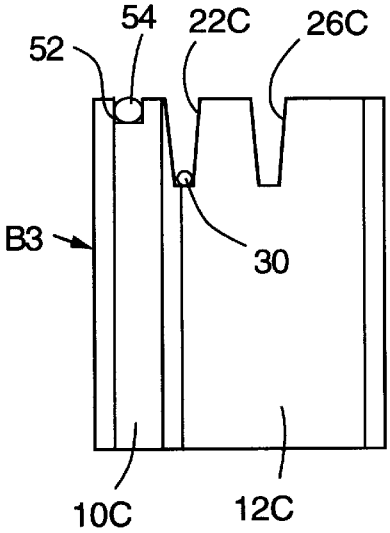
FIG. 17 is a side elevational view of the modified block of FIG. 16.

FIGS. 16 and 17 illustrate a modification of the Twin-T block B1. This modification, designated B3 corresponds to the block B1 in all aspects, except that it is provided with a longitudinally extending groove 52 for the receipt of a foam plastic sealant rod 54. The foam rod comprises a material that is easily compressed, such as backer rod. Its purpose is to seal the joint between stacked blocks. For this purpose, the groove 52 has a width approximately equal to that of the rod and a depth somewhat less than that of the rod. Assuming the rod has a ¾ inch width, that would be the width of the groove and the depth of the groove might be something less, such as ½ of an inch.

The components of the block B3 corresponding to those of the first embodiment block B1 are designated by like numerals, followed by the letter c, as follows; face section 10*c*; web sections 12*c* and 14*c;* rearward surface 16*c;* free distal edges 18*c* and 20*c;* and grooves 22*c,* 24*c,* 26*c* and 28*c.* All of these elements may correspond in construction and dimensions to the example given for the first embodiment for the sake of illustration, a rebar 30 is shown received within the groove 22*c.*

CAST IN PLACE FREE STANDING WALL

Figure 18:
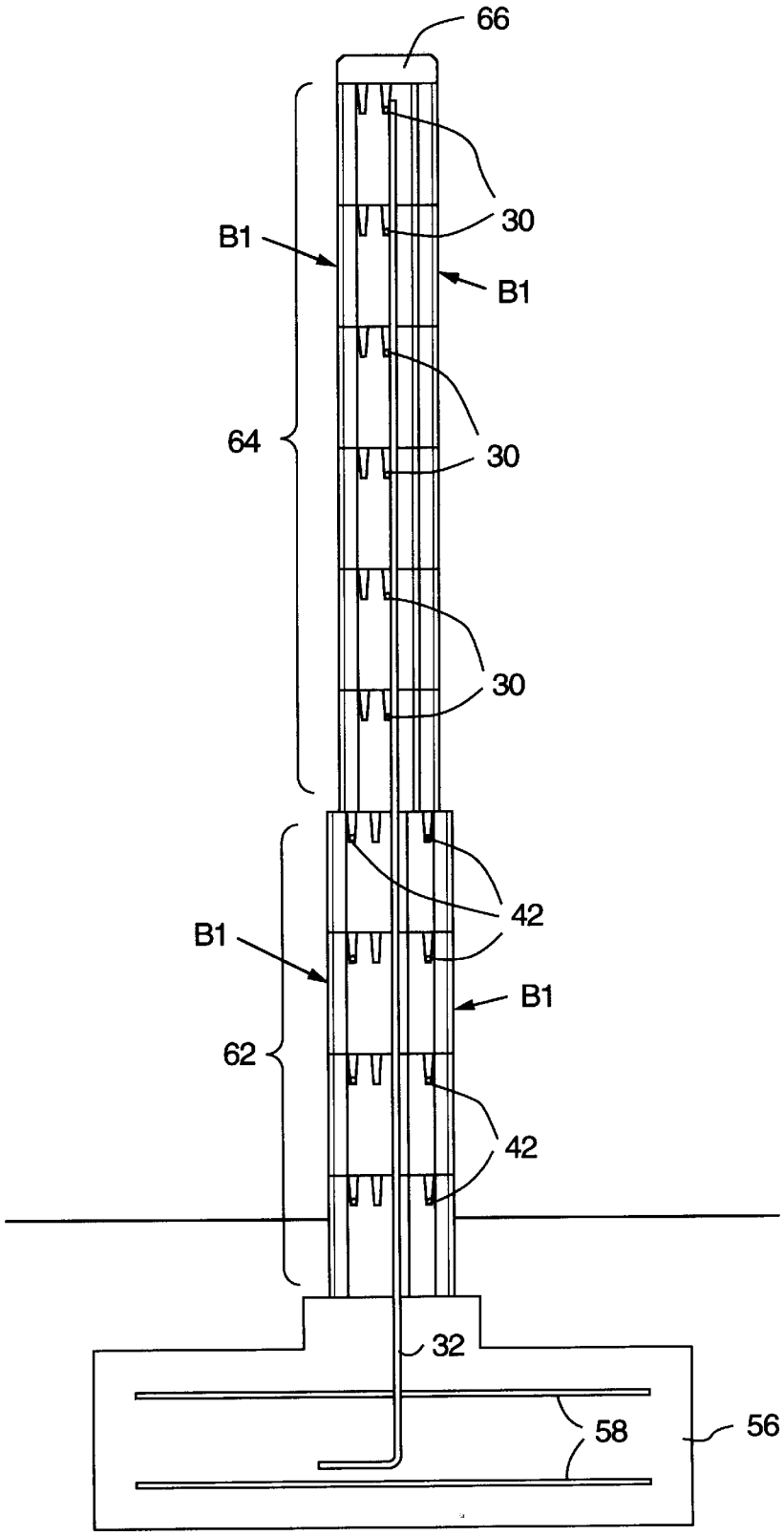
FIG. 18 is a cross-sectional elevational view of a free-standing wall constructed according to the present invention utilizing the blocks in back-to-back relationship to form a wall having two different wall thicknesses.

FIG. 18 illustrates a free standing wall constructed according to the present invention where the blocks act as the front and rear forming panels for the wall and concrete fill is cast in place within the wall between the blocks. As there shown, the wall is constructed on a concrete footer foundation 56 having horizontal steel reinforcements 58 and vertically extending steel reinforcements 32. The vertically extending reinforcements 32 correspond to those previously described and extend upwardly from the footer foundation for substantially the entire height of the wall.

The wall of FIG. 18 comprises a lower section consisting of four stacked tiers of blocks disposed back-to-back in the manner shown in FIG. 10 and an upper section 64 consisting of six stacked tiers of blocks assembled as shown in FIG. 9. The wall is filled with cast in place concrete. The rearward surfaces of the opposing blocks in sections 62 and 64 serve as the form for the concrete. The upper extremity of the wall is closed by a coping cap 66.

WALL SECTIONS JOINED BY COLUMN TO PERMIT RELATIVE SETTLING

Figure 19:
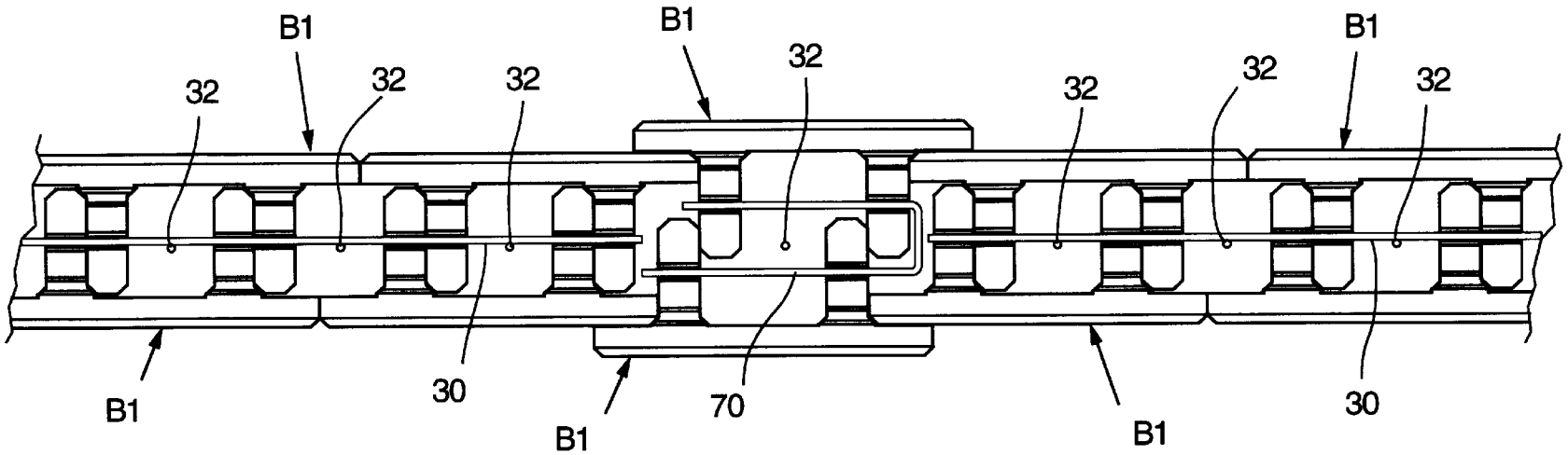
FIG. 19 is a plan view of a wall comprised of back-to-back blocks assembled as shown in FIG. 6, with a column section formed between two wall sections.

FIG. 19 illustrates a pair of wall sections constructed according to FIG. 9 joined by a column section C. Each wall section is comprised of a plurality of tiers of blocks assembled as shown in FIG. 9. The column comprises a pair of opposed blocks assembled in partially overlapping relationship between the wall sections. A special U-shaped steel reinforcing element 70 secures the blocks of the column section together and, upon filling of the void between the blocks with concrete, functions to reinforce this concrete.

Likewise, the concrete cast in place within the wall sections is reinforced by the rebar elements 30 extending therethrough, together with the vertical rebar elements 32.

From FIG. 19, it will be seen that the wall sections are isolated from one another by the column and that the column forms a slip joint between the wall sections. This slip joint is provided by the overlapping of the inside surfaces of the blocks making up the column with the outside surfaces of the blocks making up the wall sections. The vertical rebars 32 extend upwardly from foundations beneath the wall sections and the column section.

FREE STANDING COLUMN CONSTRUCTION

Figure 20:
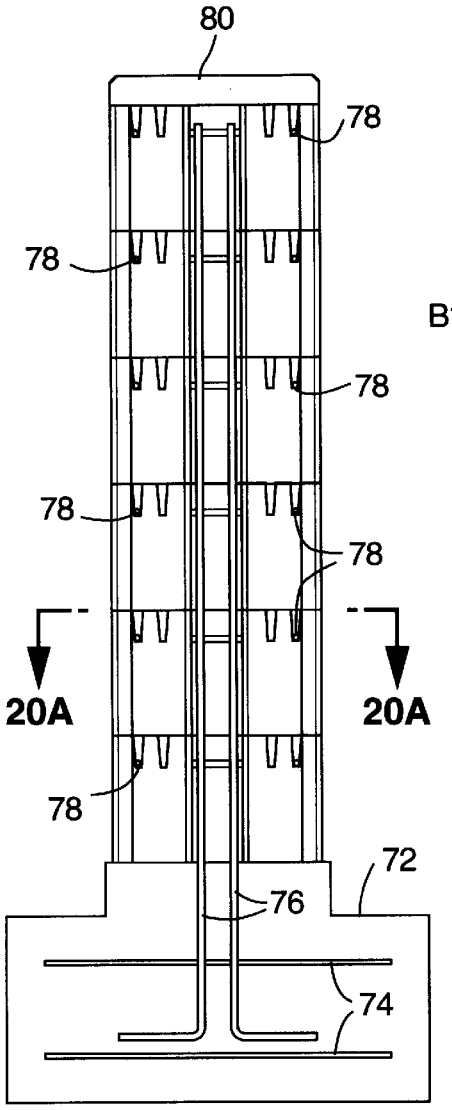
FIG. 20 is a cross-sectional elevational view of a column constructed with blocks according to the first embodiment, with the T-sections of certain of the blocks modified to accommodate the column configuration.
Figure 20A:
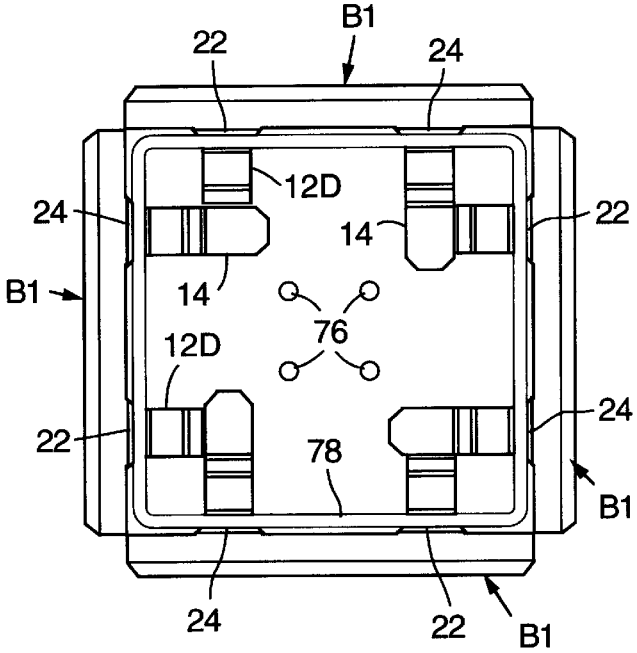
FIG. 20A is a cross-sectional view taken on the plane designated by Line 20A—20A of FIG. 20.
Figure 21:
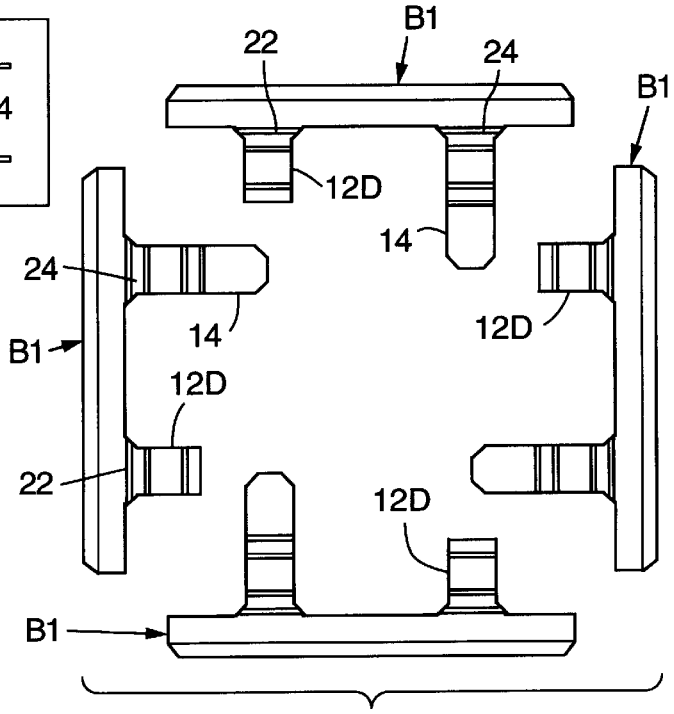
FIG. 21 is an exploded top plan view of the blocks used to construct the column of FIG. 20.

FIGS. 20 and 20A shown the blocks used in the formation of a free standing column. As there shown, a footer foundation 72 having horizontal steel reinforcements 74 and vertically extending steel reinforcements 76 is provided for support of the column. The blocks are supported on the column in opposed pairs disposed in edge-to-edge right angle relationship relative to one another. As may be seen from FIGS. 20A and 21, one web section of each block is shortened to enable the blocks to assume edge-to-edge relationship. With the blocks assembled into opposed relationship as shown in FIG. 20A, a special stirrup-shaped rebar element is engaged in the grooves 22, 24 of the blocks to hold the blocks in the assembled square configuration. The blocks provide a closed form into which concrete is placed to create a fully reinforced column.

The foreshortened web sections of the panels B1 used to form the column are designated by the numeral 12*d*. Shortening may be achieved by use of a concrete shear. The fully assembled column capped with a coping cap 80.

WALL WITH STAY-IN-PLACE WIRE FORMING COMPONENT

Figure 22A:
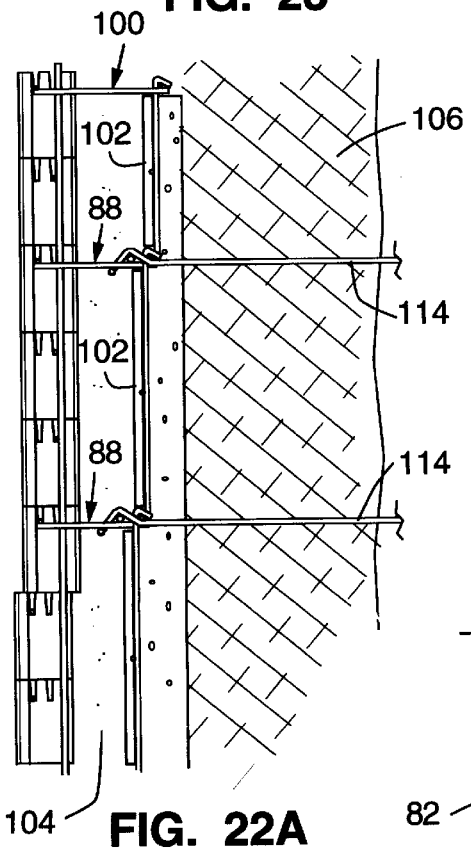
FIG. 22A is a cross-sectional elevational view of a segment of a retaining wall constructed according to FIG. 22, with the addition of soil reinforcing mats secured to the angle-shaped components of the wall.
Figure 22:
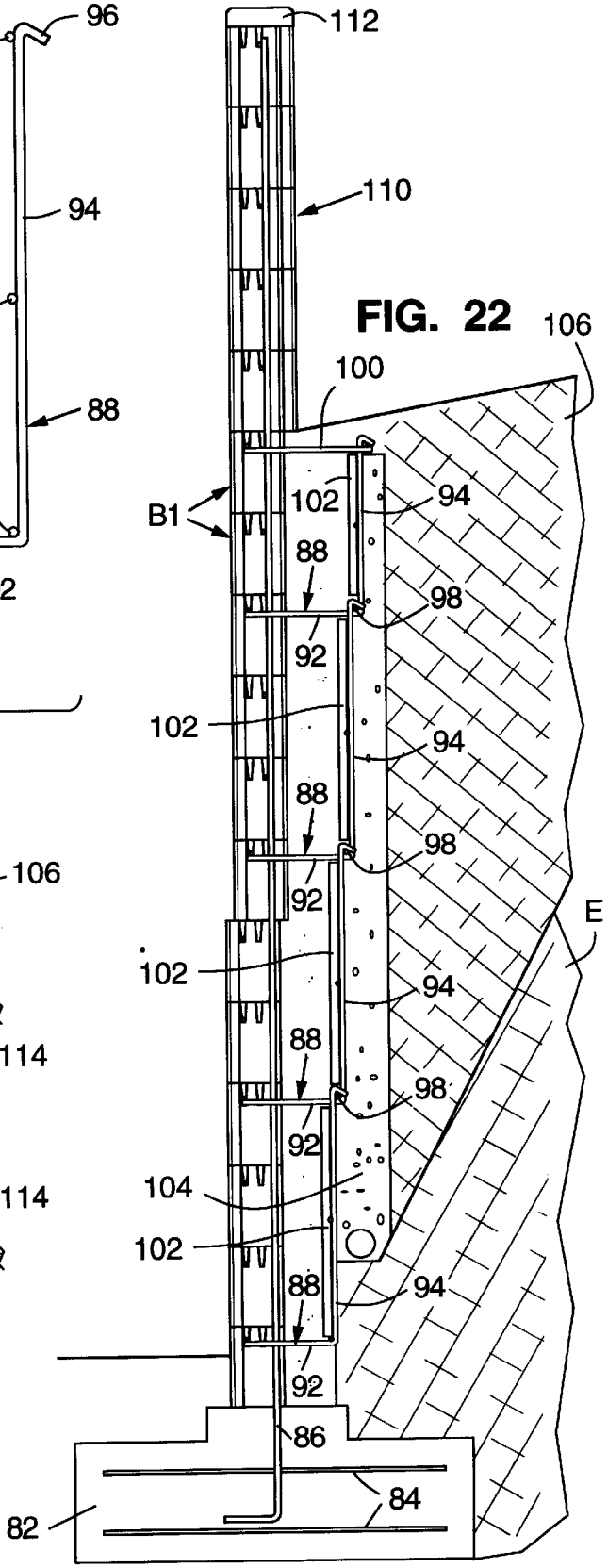
FIG. 22 is a cross-section elevational view of a retaining wall for an earthen formation with a face constructed of the blocks of the present invention and a cast in place concrete backing held to the face with angle-shaped welded wire components having elements received within the grooves of the blocks.

The wall of FIG. 22 is disposed at the face of an earthen formation E to be retained and is supported on a footer foundation 82 having horizontal reinforcing bars 84 and vertically extending reinforcing bars 86. The bars 86 extend upwardly from the foundation into the wall to be formed. The outside surface of the wall comprises stacked tiers of blocks B1 positioned so that the web sections 12 and 14 of the blocks extend toward the earthen formation. Special angle-shaped welded wire gridworks 88 having cross wires 90 are engaged with the grooves 22, 24 of the stacked blocks so that the lower distal wire 90 of each gridwork is engaged in the grooves 22, 24 of one tier of blocks. As so engaged, a lower section 92 of each gridwork extends generally horizontally from the rearward side of the blocks and an upper section 94 of each gridwork extends generally vertically in spaced relationship to the blocks. The upper extremity of each upper section 94 is formed with a hook 96 which engages over a transverse wire 90 at the intersection of the upper and lower sections of the gridwork thereabove (see FIG. 22). A horizontal welded wire gridwork 100 at the top of the uppermost gridwork 88 is engaged under the hook 96 of that gridwork and also engaged with the grooves 22, 24 of one tier of blocks to maintain the gridwork against separation from the blocks in the latter tier. The gridwork 100 does not have a vertical component.

Figure 23:
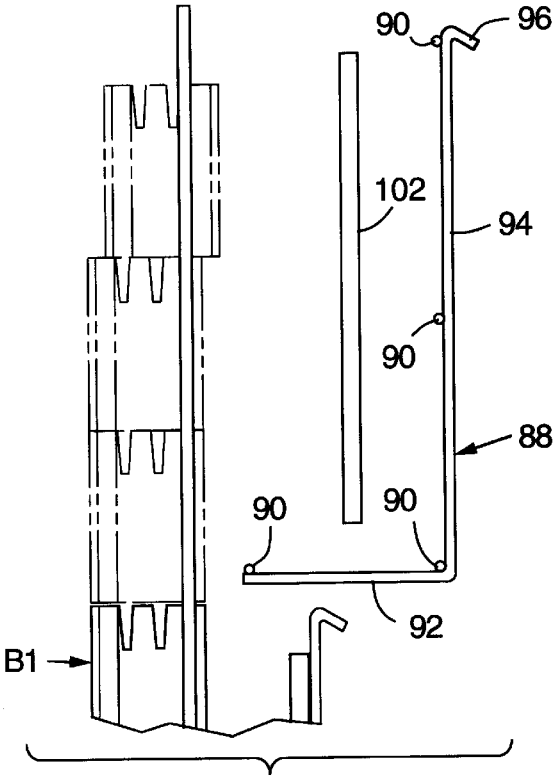
FIG. 23 is an exploded elevational view of a segment of the wall of FIG. 22, with parts thereof shown in phantom.

The stay-in-place forming component of the FIG. 22 to 23 wall also includes a forming barrier member 102 received to the inside of each of the upper sections 94. This barrier may be formed of any one of a number of materials, such as heavy filter paper. In formation of the wall, concrete is formed in place between the barrier members and the rearward surfaces of the blocks B1. The vertically extending rebars from the foundation footer 82 are also cast in place within the concrete so formed.

In the fully assembled wall shown in FIG. 22, drain rock 104 is placed behind the cast-in-place wall and backfill 106 is disposed behind the drain rock. A drain pipe 108 is located at the bottom of the drain rock 104. A freestanding wall 110 corresponding in construction to the upper section 64 of the wall shown in FIG. 18 is erected on top of the retaining wall structure shown in FIG. 22. The vertical rebars 86 extend into this freestanding wall. A coping cap 112 is positioned over the top of the freestanding wall 110.

FIG. 22A shows a variation of the FIG. 22 wall wherein the angle-shaped gridworks 88 are secured to soil reinforcing mats 114. The mats may be of any conventional construction, such as welded wire. Connection of the mats to the gridworks may be achieved, for example, by a connector of the type shown in U.S. Pat. No. 4,993,879.

PRECAST PANEL AS FACING FOR MECHANICALLY STABILIZED EARTH RETAINING WALL

Figure 24:
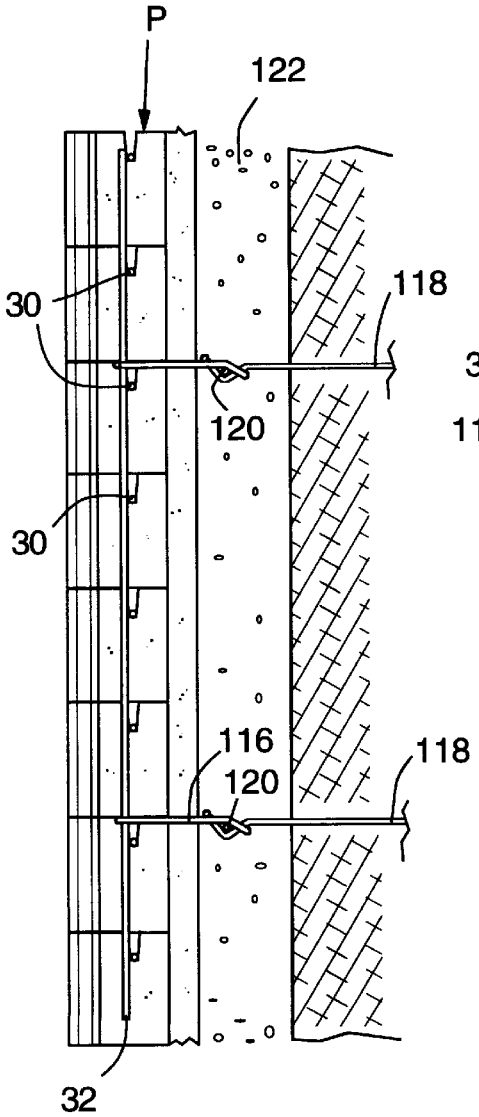
FIG. 24 is an elevational view of a segment of a wall for retaining and earthen formation, with the face panel for the wall constructed of the blocks of the present invention which are precast into the composite configuration illustrated prior to assembly of the wall.
Figure 25:
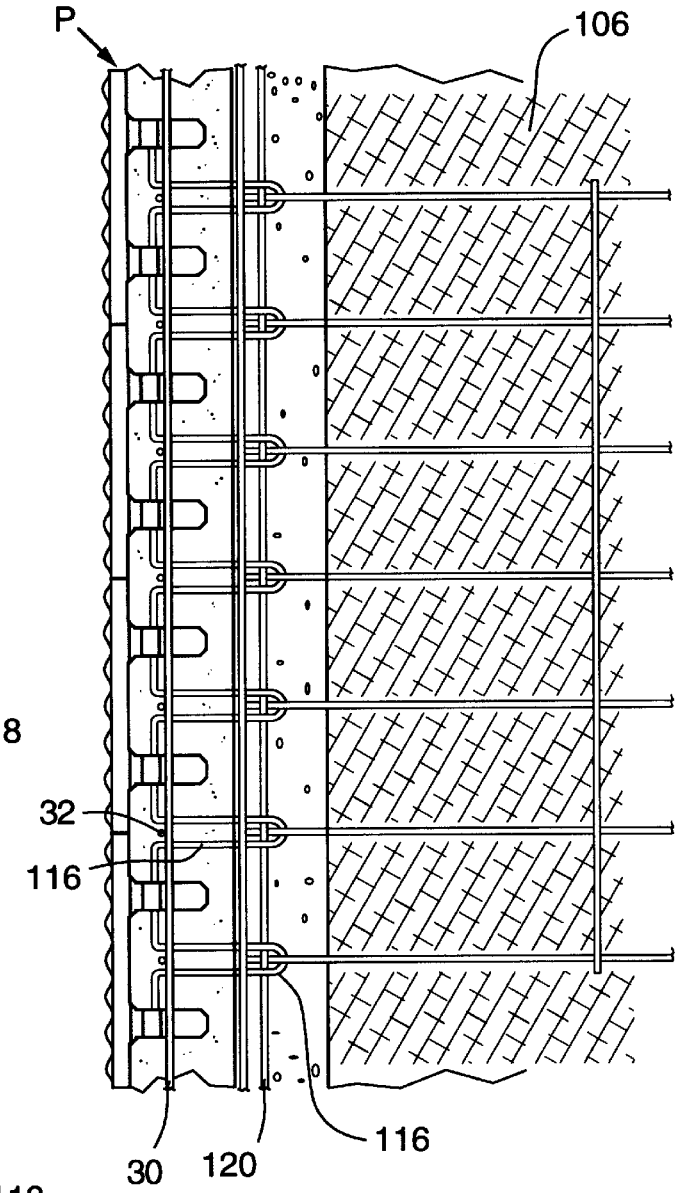
FIG. 25 is a cross-sectional plan view of the wall of FIG. 24, further illustrating the detail of the soil reinforcements for the wall and their connection to the face panel.

FIGS. 24 and 25 illustrate a precast panel fabricated of blocks constructed according to the present invention where the blocks form the face of the panel and connectors for securement to soil reinforcements are imbedded into the panel. With this arrangement, the panels are formed off site with horizontal rebars 30 received in the grooves 26, 28 and vertical rebars 32 extending through the blocks to the inside of the rebars 30. Loop-type connectors 116 of the type shown in U.S. Pat. No. 4,993,879 are also cast in place within the panels and extend rearwardly therefrom.

When assembled into place as shown in FIGS. 24 and 25, the panels, designated P are disposed at the face of the formation and secured to soil reinforcing mats 118 through the connectors 116. Connection is through means of the mechanism shown in U.S. Pat. No. 4,993,879 and is held through means of rods 120. Drain rock 122 is filled in place between the panels and the soil fill 106 of the earthen formation.

METHOD OF FORMING PRECAST PANELS

FIGS. 26A to 26J illustrate the sequence of steps employed to form a precast panel from a single layer of the inventive blocks, using a modular form. The components of the modular form and the manner in which they cooperate with the blocks are shown in exploded form in FIG. 27. From the latter figure, it will be seen that the form comprises front sections 124 against which the front faces of the blocks are placed; side sections 126 connectable to the front sections for extension therefrom to either side of a stacked array of blocks disposed against the front sections; and, back sections 128 securable to the side sections in spaced relationship to the free distal edges 18 of the blocks.

Figure 26A:
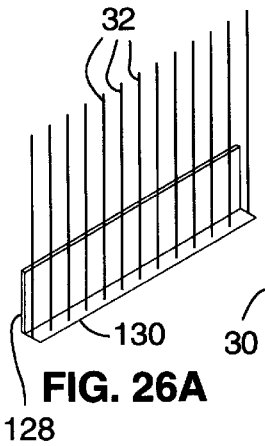
FIGS. 26A to 26J are perspective views illustrating the steps of manufacturing a precast wall panel with one layer of blocks constructed according to the present invention; and, FIG. 27 is an exploded perspective view illustrating the blocks and the forming components used to construct the wall in the method of FIGS. 26A to 26J.
Figure 26B:
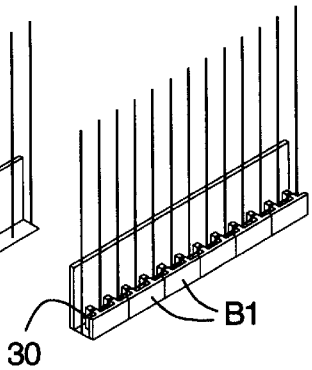
Figure 26C:
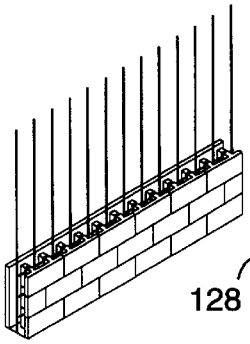
Figure 26D:
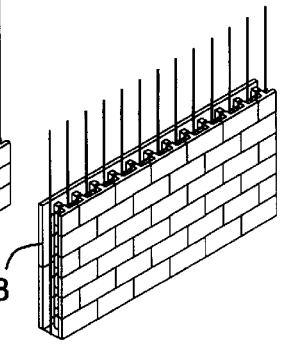
Figure 26E:
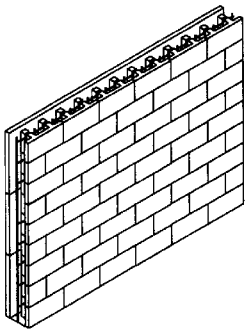
Figure 26F:
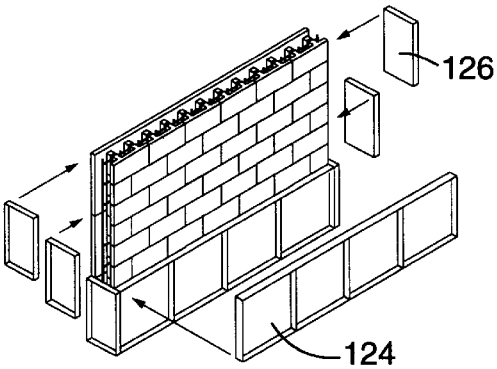
Figure 26G:
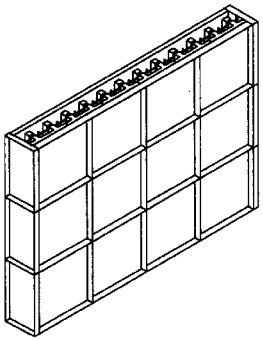
Figure 26H:
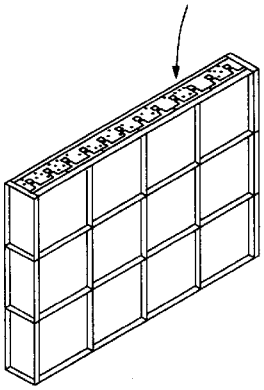
Figure 27:
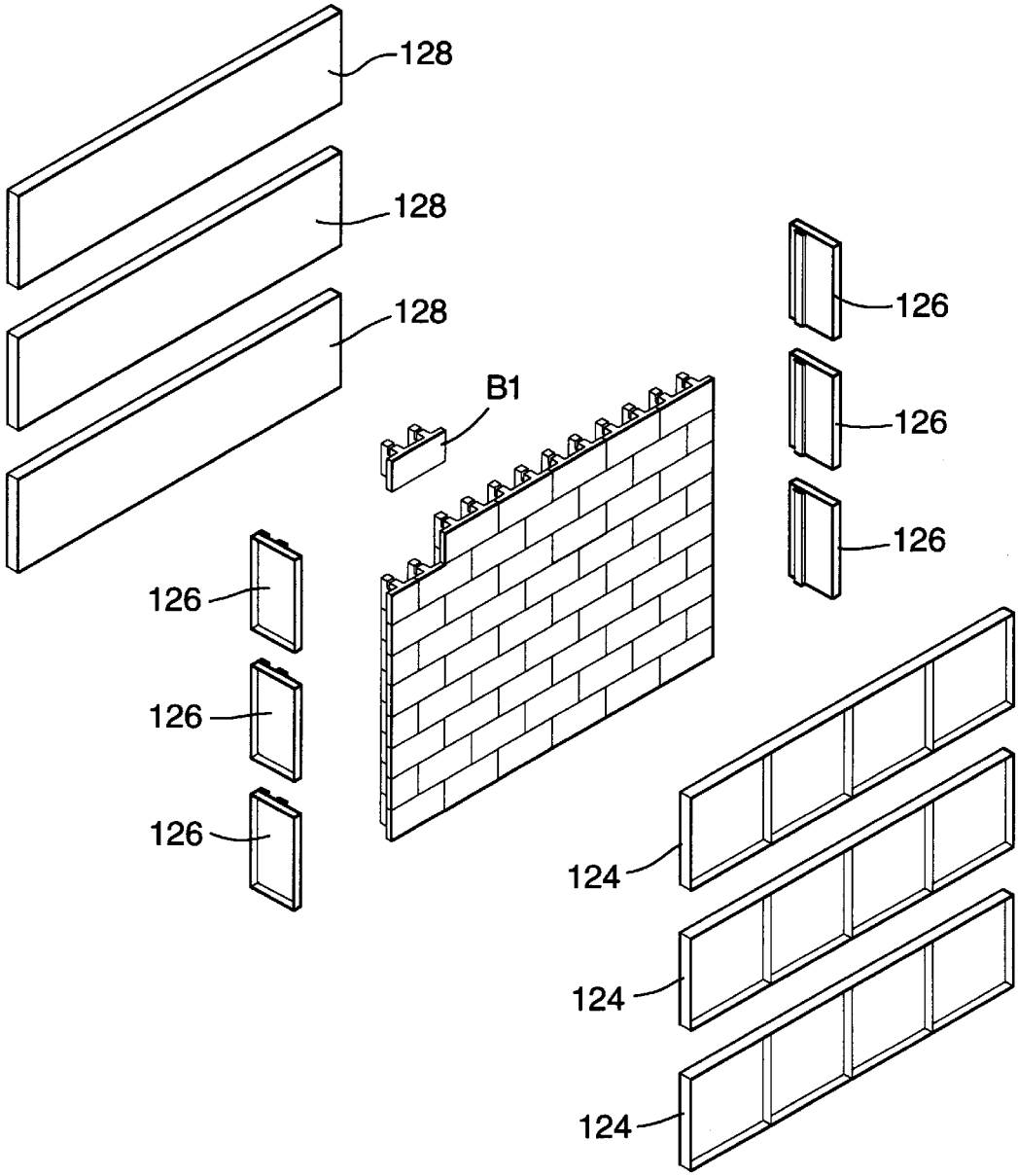

FIG. 26A shows a back section 128 with a floor element extending therefrom and carrying vertically extending rebar elements 32. FIG. 26B shows a first course of blocks B1 supported on the floor element with the vertically extending rebar elements 32 extending through the void formed between the web sections of the blocks. FIG. 26B also shows a horizontal rebar 30 received within and extending across the grooves 26, 28 in the web sections to the back of the vertical rebars 32. FIGS. 26C, D and E show the progressive build-up of the panel as successive tiers of staggered blocks are laid one above the other, with horizontal rebars 30 extending across the grooves 26, 28 of the blocks in each tier. FIG. 26E shows the blocks assembled to the full area of the panel to be formed. FIG. 26F shows the panel of assembled blocks in the process of having the modular form attached thereto. As there seen, the back sections are in place and the side and front sections are in the process of being placed. FIG. 26G shows the form sections fully assembled around the block panel and ready for the receipt of concrete grout. FIG. 26H shows the form sections around the panel assembly of concrete blocks after the voids between the blocks and the form have been filled and vibrated.

Figure 26I:
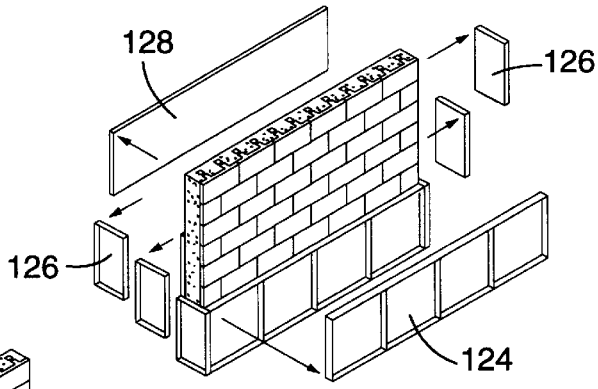

FIG. 26I shows the form panel with the concrete grout set in place and the sections of the modular form in the process of being removed.

Figure 26J:
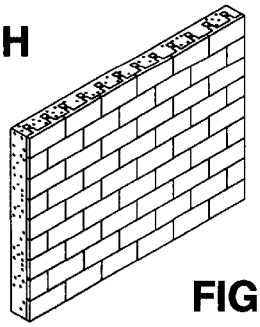

FIG. 26J shows the resulting panel, with the form removed.

Conclusion

From the foregoing detailed description, it is believed apparent that the present invention enables the attainment of the objects initially set forth herein. In particular, the invention provides an improved single thickness concrete block of a generally T-shaped configuration adapted for assembly into both preformed and insitu formed concrete panels. In its more specific aspect, the invention provides various wall panel constructions which may be assembled from the blocks and an improved method of forming such panels. In all embodiments, the invention provides such a wall which is reinforced by rebar extending therethrough.

While preferred embodiments of the invention have been illustrated and described, it is to be understood that the invention is not intended to be limited to the specifics of these embodiments, but rather as defined by the accompanying claims.

What is claimed is:

1. A concrete block for engagement with a rebar in the construction of a reinforced concrete wall, said block comprising:

a) a first generally planar section, said section being of a single thickness and having forward and rearward surfaces;

b) a second generally planar section integrally formed with the first planar section, said second section being of a single thickness and extending from the rearward surface of the first section and terminating in a free distal edge to form a generally T-shaped configuration with the first section; and, c) a groove extending across and opening through an upper edge portion of the second planar section for receipt of a rebar element, said groove having a depth greater than the thickness of the rebar element.

2. A block according to claim 1 further comprising:

a) a third generally planar section integrally formed with the first planar section, said third planar section being of a single thickness, terminating in a free distal edge, and extending from the rearward surface of the first section in spaced generally parallel relationship to the second planar section;

b) a groove extending across and opening through an upper edge portion of the third planar section in generally transverse alignment with the groove extending across the second planar section for receipt of a rebar element, the groove extending across the upper edge of the third planar section having a depth greater than the thickness of the rebar element.

3. A block according to claim 1 further comprising a sealant groove extending lengthwise of and opening through an upper edge portion of the first planar section for receipt of resilient sealant member.

4. A block according to claim 3 further comprising a resilient sealant member received within the sealant groove, said sealant member having a height greater than the depth of the sealant groove whereby said member extends partially out of the sealant groove.

5. An assembly for constructing a rebar reinforced concrete wall, said assembly comprising:

a) a pair of concrete blocks each comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element, said blocks being assembled into a condition with the rearward surfaces of the first sections thereof facing each other to define a void between the first planar sections of the blocks into which the second planar sections extend;

b) a rebar element received within the grooves of the blocks and extending at least partially across the void between the blocks.

6. An assembly according to claim 5 wherein said blocks each further comprise:

a) a third generally planar section integrally formed with the first planar section, said third planar section being of a single thickness, terminating in a free distal edge, and extending from the rearward surface of the first section in spaced generally parallel relationship to the second planar section;

b) a groove extending across and opening through an upper edge portion of the third planar section in generally transverse alignment with the groove formed in the second planar section for receipt of a rebar element, the groove extending across the upper edge of the third planar section having a depth greater than the thickness of the rebar element.

7. An assembly according to claim 5 or 6 wherein the grooves in the respective blocks are transversely aligned when the blocks are assembled into the condition with the rearward surfaces facing each other and the rebar elements extend through the transversely aligned grooves to secure the blocks together.

8. An assembly according to claim 5 or 6 wherein:

a) the grooves in the respective blocks are transversely spaced relative to one another when the blocks are assembled into the condition with the rearward surfaces facing each other; and, b) the rebar elements comprise rebars extending through the grooves in the respective blocks in spaced relationship relative to one another.

9. An assembly according to claim 8 wherein the rebars extending through the grooves in the respective blocks are secured to one another and serve to secure the blocks together.

10. A concrete structure comprising:

a) a foundation having rebar reinforcing elements secured thereto and extending upwardly therefrom;

b) paired preformed concrete blocks supported on said foundation, said blocks each comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element, the blocks are supported on the foundation with the planar surfaces in a generally upright condition and the rearward surfaces of the first sections of the respective blocks facing each other in spaced relationship to define a void between the blocks into which the rebar reinforcing elements extending upwardly from the foundation and the second planar sections extend;

b) a transverse rebar element received within the grooves of the blocks and extending at least partially across the void between the blocks; and, c) cast in place concrete received within the void between the blocks.

11. A concrete structure according to claim 10 wherein said blocks each further comprise:

a) a third generally planar section integrally formed with the first planar section, said third planar section being of a single thickness, terminating in a free distal edge, and extending from the rearward surface of the first section in spaced generally parallel relationship to the second planar section;

b) a groove extending across and opening through an upper edge portion of the third planar section in generally transverse alignment with the groove extending across the second planar section for receipt of a rebar element, the groove extending across the upper edge of the third planar section having a depth greater than the thickness of the rebar element.

12. A concrete structure according to claim 10 or 11 wherein a plurality of the paired blocks are stacked to provide an upstanding wall and the void formed between the blocks is continuous over the height of the wall.

13. A concrete structure according to claim 12 further comprising a support column engaged with an end of the wall, said column comprising:

a) stacked pairs of concrete column blocks, the column blocks of each pair comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element, said column blocks being assembled into a condition with the rearward surfaces of the first sections thereof facing each other in spaced relationship to define a void between the blocks into which rebar elements from the foundation extend and the end of the wall slidably extends;

b) rebar elements received within the grooves of the paired column blocks to tie the column blocks together in assembled condition; and, c) cast in place concrete received within the void between the column blocks.

14. A concrete structure according to claim 13 wherein said column blocks each further comprise:

a) a third generally planar section integrally formed with the first planar section of the column block, said third planar section being of a single thickness, terminating in a free distal edge, and extending from the rearward surface of the first section of the column block in spaced generally parallel relationship to the second planar section;

b) a groove extending across and opening through an upper edge portion of the third planar section of the column block in transverse alignment with the groove formed in the second planar section of the column block for receipt of a rebar element, the groove extending across the upper edge of the third planar section having a depth greater than the thickness of the rebar element.

15. A concrete column comprising:

a) a foundation having rebar reinforcing elements secured thereto and extending upwardly therefrom;

b) two sets of paired preformed concrete blocks supported on said foundation, the blocks of each set comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element, the blocks of the respective sets being assembled into a condition in with the rearward surfaces of the first sections thereof facing each other in spaced relationship, the blocks of one set being disposed in edge-to-edge generally right angled relationship to the blocks of the other set whereby a peripherally closed void is defined between the blocks into which the rebar reinforcing elements extending upwardly from the foundation and the second planar sections extend;

b) a stirrup shaped rebar element received within the grooves of the blocks to tie the blocks together; and, c) cast in place concrete received within the void between the blocks.

16. A retaining wall for an earthen formation comprising, in combination:

a) a face panel comprised of preformed concrete blocks supported at the face of the foundation in side-by-side stacked relationship, said blocks each comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element, the blocks are supported at the face of the formation with the first planar sections in a generally upright condition and the rearward surfaces of the first sections facing the formation so that the second planar sections of the blocks extend toward the formation;

b) transverse rebar elements extending across and received within the grooves of at least certain of the blocks which are disposed in side-by-side relationship; and, c) concrete cast in place against the rearward surfaces of the first sections of the blocks and around the second sections of the stacked blocks.

17. A retaining wall according to claim 16 further comprising earth anchor connecting elements embedded within the cast in place concrete and extending therefrom toward the earthen formation.

18. A retaining wall according to claim 17 wherein the anchor connecting elements include transverse elements received within the grooves of the second planar sections of at least certain of the blocks.

19. A retaining wall according to claim 17 or 18 further comprising soil reinforcing elements embedded within the earthen formation and secured to the anchor connecting elements.

20. A retaining wall according to claim 16 further comprising drain rock disposed between the cast in place concrete and the earthen formation.

21. A retaining wall according to claim 16 further comprising angle-shaped welded wire mats, said mats each having:

a) a generally horizontal section with a transverse wire received within the grooves in the second planar sections of at least certain of said blocks;

b) a generally vertical section disposed between the blocks and the earthen formation;

said vertical sections of the mats carrying barrier elements and the cast in place concrete being formed between the blocks and the barrier elements.

22. A retaining wall according to claim 21 wherein the angle-shaped mats are disposed successively one above the other and the vertical sections of successive mats are secured together.

23. A retaining wall according to claim 21 further comprising earth anchors secured to the generally horizontal sections of at least certain of the mats and extending therefrom into the earthen formation.

24. A retaining wall according to claim 16 further comprising a foundation located at the face of the formation and having rebar reinforcing elements secured thereto and extending upwardly therefrom, said blocks being supported on the foundation with the rebar reinforcing elements extending upwardly from the foundation disposed between at least certain of the second sections.

25. A method of forming a concrete panel, said method comprising:

a) providing a plurality of preformed concrete blocks supported in side-by-side stacked relationship, said blocks each comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar element, said groove having a depth greater than the thickness of the rebar element;

b) extending first rebar elements through and across the grooves of at least certain of the blocks which are disposed in side-by-side relationship;

c) supporting a form panel in spaced relationship to the rearward surfaces of the first generally planar sections of the stacked blocks; and, d) casting concrete in place around the second sections of the stacked blocks between the form panel and the rearward surfaces of the first sections of the stacked blocks.

26. A method according to claim 25 further comprising extending second rebar elements across the stacked blocks between the second sections thereof prior to the step of casting concrete in place.

27. A concrete panel comprising:

a) a plurality of preformed concrete blocks supported in side-by-side stacked relationship, said blocks each comprising:

1) a first generally planar section, said section being of a single thickness and having forward and rearward surfaces;

2) a second generally planar section integrally formed with the first planar section, said second section being of a single thickness and extending from the rearward surface of the first section and terminating in a free distal edge to form a generally T-shaped configuration with the first section; and, 3) a groove extending across and opening through an upper edge portion of the second planar section for receipt of a rebar elements, said groove having a depth greater than the thickness of the rebar element;

b) rebar elements extending through and across the grooves of at least certain of the blocks which are disposed in side-by-side relationship; and, c) concrete cast in place around the second sections of the stacked blocks and against the rearward surfaces of the first sections of the stacked blocks.

* * * * *